US010475610B2

(12) United States Patent
Sakai

(10) Patent No.: US 10,475,610 B2
(45) Date of Patent: Nov. 12, 2019

(54) ELECTRIC CIRCUIT BREAKER DEVICE

(71) Applicant: DAICEL CORPORATION, Osaka-shi, Osaka (JP)

(72) Inventor: Toshiyuki Sakai, Tatsuno (JP)

(73) Assignee: DAICEL CORPORATION, Osaka-Shi (JP)

( * ) Notice: Subject to any disclaimer, the term of this patent is extended or adjusted under 35 U.S.C. 154(b) by 0 days.

(21) Appl. No.: 16/267,136

(22) Filed: Feb. 4, 2019

(65) Prior Publication Data

US 2019/0172669 A1 Jun. 6, 2019

Related U.S. Application Data

(62) Division of application No. 15/515,102, filed as application No. PCT/JP2015/079489 on Oct. 20, 2015, now Pat. No. 10,229,801.

(30) Foreign Application Priority Data

Oct. 29, 2014 (JP) ..... 2014-220088

(51) Int. Cl.
*H01H 39/00* (2006.01)

(52) U.S. Cl.
CPC ..... *H01H 39/006* (2013.01); *H01H 2039/008* (2013.01)

(58) Field of Classification Search
CPC ..... H01H 39/006; H01H 2039/008
(Continued)

(56) References Cited

U.S. PATENT DOCUMENTS 6,194,988 B1 2/2001 Yamaguchi et al.
6,222,439 B1 4/2001 Tanigawa et al.
(Continued)

FOREIGN PATENT DOCUMENTS

DE 199 29 922 A1 1/2000
EP 2 787 521 A1 10/2014
(Continued)

OTHER PUBLICATIONS

Extended European Search Report, dated Apr. 26, 2018, issued in corresponding European patent application No. 15854402.3.
(Continued)

*Primary Examiner* — Edwin A. Leon
*Assistant Examiner* — Lheiren Mae A Caroc
(74) *Attorney, Agent, or Firm* — Birch, Stewart, Kolasch & Birch, LLP

(57) ABSTRACT

An electric circuit breaker device includes a cylindrical space penetrating from a first end to a second end of a housing made of a synthetic resin, an igniter, a projectile made of a synthetic resin, and a conductor piece forming part of an electric circuit, which are arranged axially in this order from the first end of the housing. The conductor piece is a plate piece comprising of connection sections at both ends thereof and a cutting section as an intermediate portion. The projectile is disposed to face the surface of the cutting section of the conductor piece in the axial direction of the housing. A cylinder made of a metal for reinforcing the housing is disposed between the projectile and an inner wall surface of the housing; the projectile has a constricted part fitted with an O-ring abutting against an inner periphery of the cylinder.

4 Claims, 2 Drawing Sheets

(58) Field of Classification Search
USPC ..... 200/61.08
See application file for complete search history.

(56) References Cited

U.S. PATENT DOCUMENTS

| | | | | |
|---|---|---|---|---|
| 9,236,208 | B2 | 1/2016 | Ukon et al. | |
| 10,229,801 | B2 * | 3/2019 | Sakai | H01H 39/006 |
| 2004/0221638 | A1 | 11/2004 | Brede et al. | |
| 2005/0083164 | A1 | 4/2005 | Caruso et al. | |
| 2005/0083165 | A1 | 4/2005 | Tirmizi | |
| 2012/0234162 | A1 | 9/2012 | Tirmizi | |
| 2013/0255463 | A1 * | 10/2013 | Ukon | H01H 39/006 83/639.1 |
| 2013/0255464 | A1 | 10/2013 | Ukon et al. | |
| 2013/0263714 | A1 | 10/2013 | Ukon et al. | |
| 2013/0263715 | A1 * | 10/2013 | Ukon | H01H 39/006 83/639.1 |
| 2014/0061161 | A1 | 3/2014 | Nakamura et al. | |
| 2015/0206681 | A1 | 7/2015 | Marlin et al. | |

FOREIGN PATENT DOCUMENTS

| | | | |
|---|---|---|---|
| FR | 2 992 770 | A1 | 1/2014 |
| JP | 11-232979 | A | 8/1999 |
| JP | 4344255 | B2 | 10/2009 |
| JP | 2013-239412 | A | 11/2013 |
| JP | 2014-49300 | A | 3/2014 |
| WO | WO 2014/001713 | A1 | 1/2014 |

OTHER PUBLICATIONS

International Preliminary Report on Patentability and English translation of Written Opinion of the International Searching Authority, dated May 2, 2017, issued in PCT/JP2015/079489 (Forms PCT/IB/373 and PCT/ISA/237).

International Search Report for PCT/JP2015/079489 (PCT/ISA/210) dated Jan. 12, 2016.

Japanese Office Action, dated Jul. 10, 2018, for corresponding Japanese Application No. 2014-220088, with an English machine translation.

Non-Final Office Action issued in U.S. Appl. No. 15/515,102 dated Jan. 17, 2018.

Notice of Allowance issued in U.S. Appl. No. 15/515,102 dated Jan. 24, 2019.

Written Opinion of the international Searching Authority for PCT/JP2015/079489 (PCT/ISA/237) dated Jan. 12, 2016.

* cited by examiner

[Fig. 1]
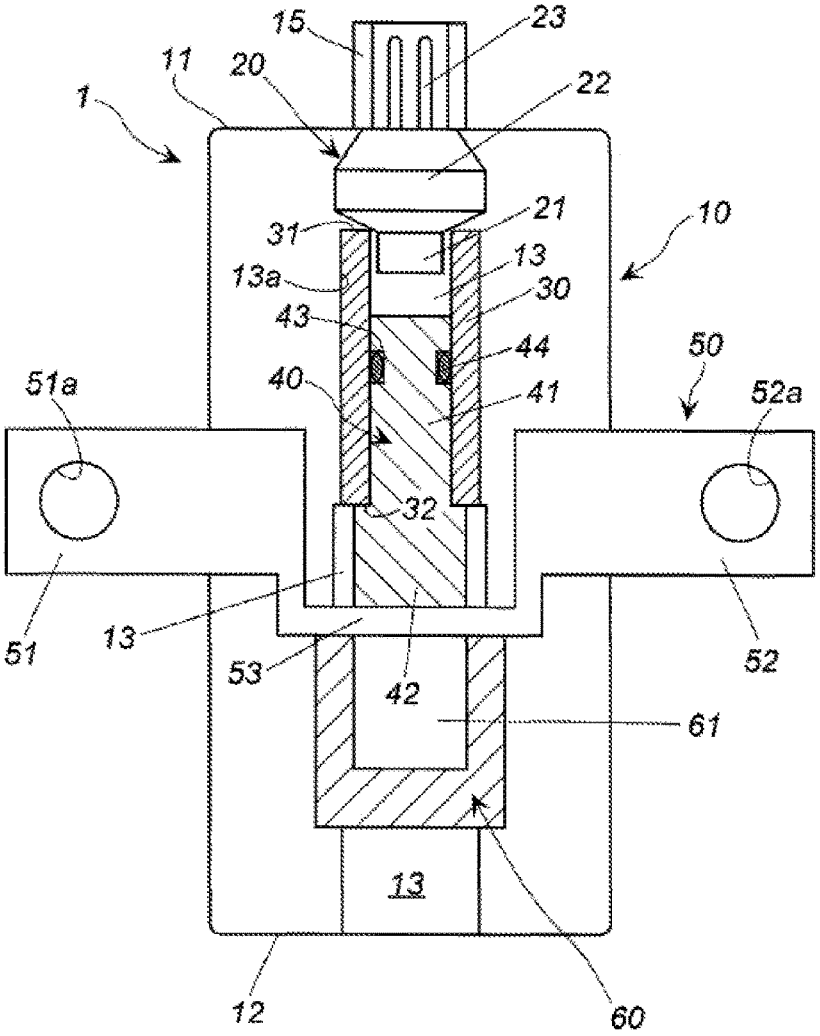
[Fig. 2]
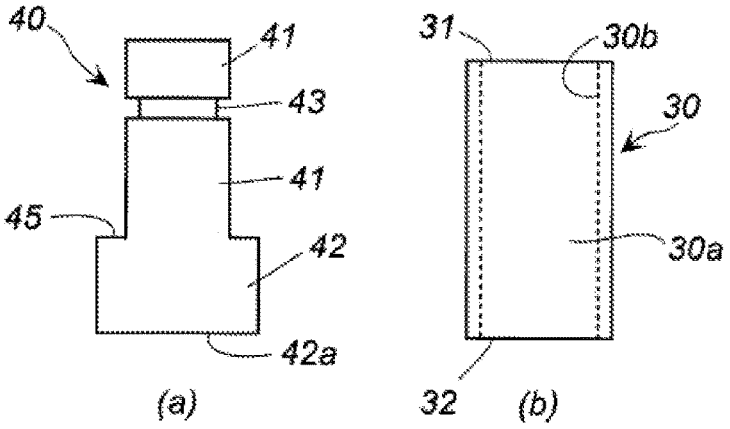

[Fig. 3]
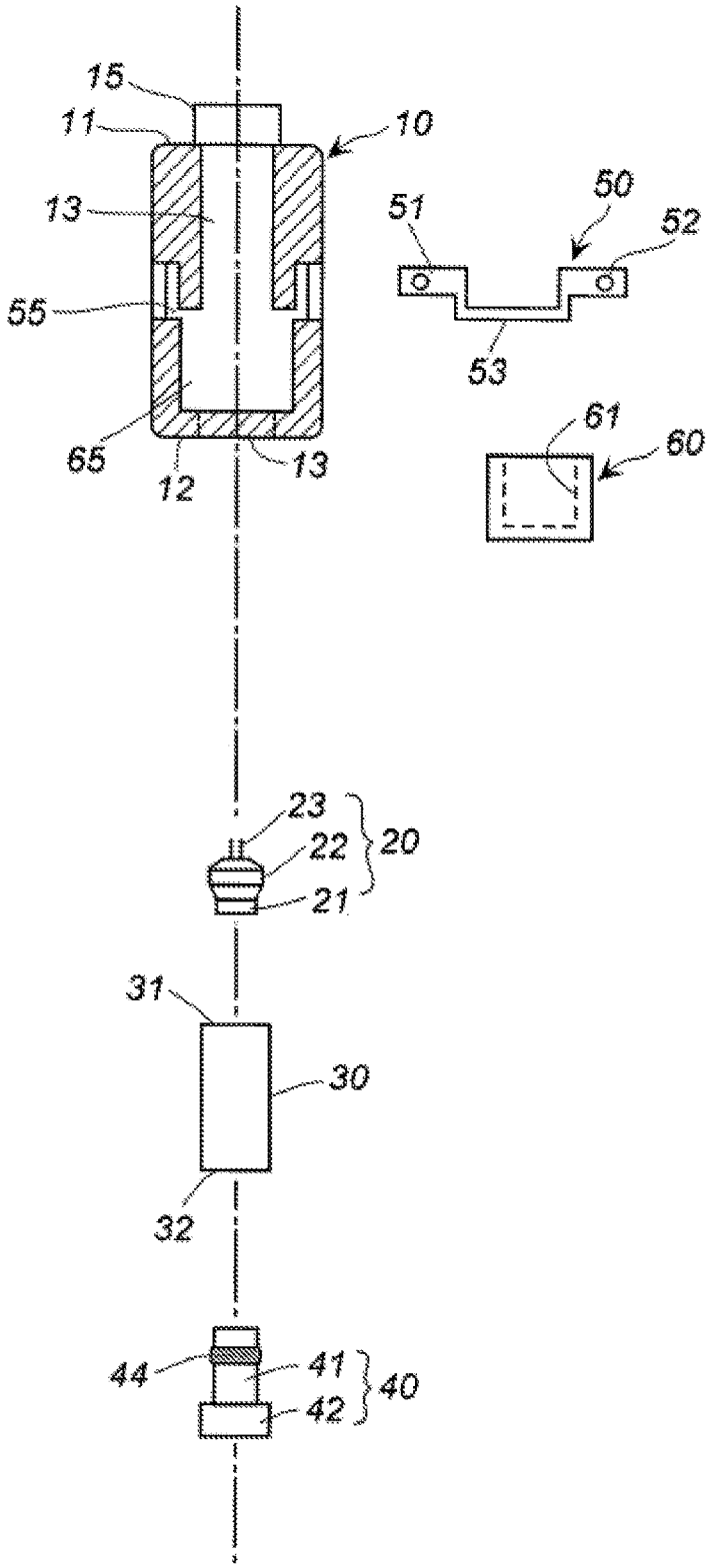

ELECTRIC CIRCUIT BREAKER DEVICE

CROSS-REFERENCE TO RELATED APPLICATIONS

This application is a Divisional of U.S. patent application Ser. No. 15/515,102, filed on Mar. 28, 2017, which is a National Stage of International Patent Application No. PCT/JP2015/079489, filed on Oct. 20, 2015, which claims priority to Japan Patent Application No. 2014-220088, filed on Oct. 29, 2014, all of which are hereby expressly incorporated by reference into the present application.

TECHNICAL FIELD

The present invention relates to an electric circuit breaker device, which can be used in electric circuits in automobiles or electric home appliances.

DESCRIPTION OF RELATED ART

In the case of an abnormality and the like of an electric circuit itself of automobiles, electric home appliances and others, or an entire system including the electric circuit, used are electric circuit breaker devices that prevent large damages by breaking electric circuits.

An electric circuit breaker device having an igniter, a projectile (piston), a conductor and others accommodated in a housing is known (US-A No. 2005/0083164, US-A No. 2005/0083165, US-A No. 2012/0234162, JP-A No. H11-232979 and JP-A No. 2014-49300).

In US-A No. 2005/0083164 and US-A No. 2005/0083165, metals, ceramics and polymers are exemplified as a material for a housing, and it is described that a specific polymer is preferred (pages 2 to 3 of US-A No. 2005/0083164 and page 2 of US-A No. 2005/0083165).

In JP-A No. H11-232979, a casing 13 is made of stainless steel (paragraph No. 0011).

In JP-A No. 2014-49300, a case 30 has electrical insulation and is made of a material having a high strength (for example, a resin material) (paragraph No. 0034).

SUMMARY OF INVENTION

The present invention provides an electric circuit breaker device including, in a cylindrical space penetrating from a first end to a second end of a housing made of a synthetic resin, an igniter, a projectile made of a synthetic resin, and a conductor piece forming part of an electric circuit, which are arranged axially in this order from the first end of the housing; and having an insulating space for receiving a cut portion of the conductor piece between the second end of the housing and the conductor piece, wherein the conductor piece is a plate piece composed of connection sections at both ends thereof and a cutting section as an intermediate portion, and is disposed so that the cutting section has a surface perpendicular to the axial direction of the housing;

the projectile is disposed to face the surface of the cutting section of the conductor piece in the axial direction of the housing; and a cylinder made of a metal for reinforcing the housing is disposed between the projectile and an inner wall surface of the housing.

BRIEF DESCRIPTION OF DRAWINGS

The present invention will become more fully understood from the detailed description given hereinbelow and the accompanying drawings which are given by way of illustration only, and thus are no limitative of the present invention and wherein:

FIG. 1 shows an axial cross-sectional view of an electric circuit breaker device of the present invention;

FIG. 2 shows, in (a), a plan view of a projectile used in the electric circuit breaker device of FIG. 1, and, in (b), a plan view of a cylinder used in the electric circuit breaker device of FIG. 1; and FIG. 3 shows an explanatory view on a method for assembling the electric circuit breaker device of the present invention.

DETAILED DESCRIPTION OF INVENTION

When a polymer material (resin material) is used, a housing (casing) has to have a thick wall in terms of imparting a necessary strength as can be understood from, for example, FIG. 1 of each of US-A No. 2005/0083164, US-A No. 2005/0083165 and JP-A No. 2014-49300.

When a casing of stainless steel is used as in JP-A No. H11-232979, in addition to a large increase of mass, an insulation case 14 has to be arranged in combination, resulting in a complicated structure and assembly.

When a circuit breaker is used in an automobile battery, for example, a lithium-ion battery, it is desired to reduce a thickness of a housing as much as possible thereby to downsize the entire.

The present invention provides an electric circuit breaker device, which can reduce a thickness of a housing while maintaining a required strength thereby to downsize the entire thereof.

The electric circuit breaker device of the present invention is installed to and used for various electric circuits of automobile batteries (lithium ion battery, etc.), electric home appliances and others, and shuts off an electric circuit if an abnormality occurs in the electric circuit.

The electric circuit breaker device of the present invention is characterized by using a cylinder as a member for reinforcing a housing.

The housing is made of a synthetic resin, and its outer shape is appropriately determined depending on a region, to which it is installed.

The housing has such shape, structure and size as to accommodate parts such as an igniter, a projectile, a cylinder, and a conductor piece or have them installed thereto.

The igniter is an igniter for a gas generator used in an airbag apparatus for an automobile in addition to igniters used in publicly-known electric circuit breaker devices.

The igniter has an ignition portion having an ignition charge and an electro-conductive pin for energization, and at the time of activation, is energized by an external power source to burn the ignition charge, thereby generating a combustion product such as combustion gas or flames.

The projectile is for, upon receipt of a pressure of the combustion product generated by activation of the igniter, moving axially in the housing to cut the conductor piece and break an electric circuit.

The projectile has a tip end, which may have a sagittate shape as indicated by reference numeral 34 in FIG. 1 of US-A No. 2005/0083164 and US-A No. 2005/0083165, or a flat surface like a piston 6 in FIG. 1 of US-A No. 2012/0234162.

As the projectile, usable is one made of the same synthetic resin as the housing.

As the conductor piece, usable is one that is the same as being used in publicly-known electric circuit breaker devices.

The conductor piece is a plate piece composed of connection sections at both ends, and a cutting section as an intermediate portion; and when it is installed to an electric circuit, it is for forming part of the electric circuit.

The conductor piece has a shape that corresponds to a shape or structure of a portion to be installed to the housing.

The device of the present invention has a cylinder that is made of a metal for reinforcing the housing and is disposed between the projectile and an inner wall surface of the housing.

As the cylinder, usable is one made of stainless steel, iron or the like.

The inner wall surface of the housing and an outer periphery of the cylinder are preferably in contact with each other.

An inner periphery of the cylinder and an outer periphery of the projectile may be in contact with each other, but they are preferably arranged so that a slight clearance is formed therebetween to facilitate the movement at the time of activation.

The cylinder preferably has the same widthwise cross-sectional shape as the projectile, but their shapes may be partially different from each other.

The device of the present invention is prepared by inserting the igniter, the cylinder and the projectile from the second end in this order into a cylindrical space of the housing, installing the conductor piece thereto, and then fixing the conductor piece by fitting a box-shape stopper with an opening at one side. At this time, the box-shape stopper has an inner space as an insulating space.

In the device of the present invention, the activation of the igniter moves the projectile axially; the tip end of the projectile collides with the cutting section of the conductor piece to cut the cutting section; and then, the tip end and a cut piece move into the insulating space.

In this way, the cutting of the cutting section causes electrical interruption thereby to break the electric circuit.

The device of the present invention uses a cylinder, so the following operational effects can be obtained.

(First Operational Effect)

Use of the cylinder made of a metal reinforces the housing, thereby reducing a wall thickness of the housing, and thus, the device itself can be downsized.

(Second Operational Effect)

A combustion product generated by activation of the igniter goes through the cylinder to collide with the projectile, so that the inner wall surface of the housing is not directly exposed to heat or a pressure of the combustion product. This enables the wall thickness of the housing to be reduced, and works with the first operational effect to contribute to the size-reduction of the device itself.

(Third Operational Effect)

The cylinder becomes a passage for the combustion product generated by activation of the igniter, therefore enabling the entire of the combustion product to collide with the projectile and functioning as a guide section when the projectile moves.

The electric circuit breaker device of the present invention is preferably one wherein:

the projectile has a diameter-enlarged tip portion and a rod portion with a smaller outer diameter than the diameter-enlarged tip portion; and the cylinder has a first end opening located at the side of the igniter and an opposite second end opening abutting against a stepped surface between the diameter-enlarged tip portion and the rod portion, and is disposed to enclose the rod portion.

The projectile has a diameter-enlarged tip portion and a rod portion with a smaller outer diameter than the diameter-enlarged tip portion.

At the time of activation, the diameter-enlarged tip portion collides with the conductor piece to break it, so the weight of the projectile can be reduced while the breaking strength on the conductor piece is maintained (fourth operational effect).

Further, the second end opening of the cylinder is allowed to abut against the stepped surface at a boundary between the diameter-enlarged tip portion and the rod portion, and before the activation, the cylinder is restricted to move toward the conductor piece, so that the cylinder of a metal is prevented from being in contact with the conductor piece.

The electric circuit breaker device of the present invention is preferably one wherein:

the projectile has a diameter-enlarged tip portion and a rod portion with a smaller outer diameter than the diameter-enlarged tip portion;

the igniter has a resin portion where part of a body of the igniter is enclosed with a resin and an ignition portion is projected from the resin portion; and the cylinder has a first end opening abutting against the resin portion of the igniter and an opposite second end opening abutting against a stepped surface between the diameter-enlarged tip portion and the rod portion, and is disposed to enclose the ignition portion of the igniter and the rod portion.

The cylinder is supported axially by the resin portion of the igniter and the stepped surface of the projectile, thus enabling easy installation to the housing. In this connection, installation can be achieved in a state where the projectile is inserted in the cylinder.

Further, the cylinder encloses the ignition portion of the igniter and the rod portion of the projectile, so the second and third operational effects are enhanced.

In addition, the second end opening of the cylinder abuts against the stepped surface at a boundary between the diameter-enlarged tip portion and the rod portion, and before the activation, the cylinder is restricted to move toward the conductor piece, so that the cylinder made of a metal is prevented from being in contact with the conductor piece.

The electric circuit breaker device of the present invention is preferably one wherein:

the projectile has a diameter-enlarged tip portion and a rod portion with a smaller outer diameter than the diameter-enlarged tip portion;

the diameter-enlarged tip portion has a widthwise cross-sectional shape of a quadrangle or a circle and the rod portion has a widthwise cross-sectional shape of a circle; and the cylinder has a widthwise cross-sectional shape of a circle.

The widthwise cross-sectional shape of the diameter-enlarged tip portion is preferably quadrangular since it is easy to cut the cutting portion of the conductor piece.

The rod portion and the cylinder, both having a widthwise cross-sectional shape of a circle, allow easy movement of the projectile.

The electric circuit breaker device of the present invention is preferably one wherein:

the projectile has a diameter-enlarged tip portion and a rod portion with a smaller outer diameter than the diameter-enlarged tip portion; and the rod portion of the projectile has a constricted part fitted with an O-ring, the O-ring abuts against an inner periphery of the cylinder and the rod portion has an outer surface free from contact with the inner periphery of the cylinder.

In such a way, the rod portion of the projectile contacts, only at the O-ring, the inner periphery of the cylinder. This allows easy movement of the projectile at the time of activation and prevents a combustion product generated from the igniter from running out between the cylinder and the rod portion.

Therefore, the second and third operational effects are enhanced.

The electric circuit breaker device of the present invention is reinforced by disposing a cylinder made of a metal in a housing made of a synthetic resin, and this enables the housing to have a reduced wall thickness while a required strength is maintained, thereby downsizing the entire of the device.

EMBODIMENT OF INVENTION

An embodiment of an electric circuit breaker device 1 of the present invention will be explained by referring to FIGS. 1 and 2.

The electric circuit breaker device 1 of the present invention is novel in that a cylinder 30 is used, and other parts are the same as those used in publicly-known electric circuit breaker devices.

However, the cylinder 30 is novel, so the arrangement relationships between the cylinder 30 and the other parts are novel.

A housing 10 made of a synthetic resin has a cylindrical space 13 penetrating from a first end 11 and a second end 12.

At the side of the first end 11, a connector fitting portion 15 connected to a power source by a lead wire is installed during use.

In the cylindrical space 13 of the housing 10, an igniter 20, a projectile 40 made of a synthetic resin, and a conductor piece 50 are axially arranged in this order from the first end 11.

The igniter 20 has an ignition portion 21 and a resin portion 22 where part of a body of the igniter having a conductor pin 23 is enclosed with a resin, and the ignition portion 21 is projected from the resin portion 22.

The projectile 40 shown in FIG. 1 and FIG. 2(*a*) has a rod portion 41 and a diameter-enlarged tip portion 42 formed at a tip of the rod portion 41.

The diameter-enlarged tip portion 42 has an outer diameter larger than the rod portion 41, so a circular stepped surface 45 is formed at a boundary portion between the rod portion 41 and the diameter-enlarged tip portion 42.

The rod portion 41 has a widthwise cross-sectional shape of a circle, and the diameter-enlarged tip portion 42 has a widthwise cross-sectional shape of a quadrangle (preferably a square) or a circle.

The rod portion 41 has a constricted part 43 where part of the outer diameter is smaller, and an O-ring 44 made of rubber (for example, silicone rubber) or a synthetic resin is fitted into the constricted part 43.

Regarding the outer diameter of the rod portion 41 and the outer diameter of a portion where the O-ring 44 is fitted, the outer diameter of the portion where the O-ring 44 is fitted is slightly larger.

The cylinder 30 shown in FIG. 1 and FIG. 2(*b*) is for reinforcing the housing 10, and it is made of a metal such as stainless steel or iron.

The thickness of the cylinder 30 is varied depending on the size of the device 1, but it is preferably in the range of about 0.5 to 3 mm in order to produce the above-described first to third operational effects.

The cylinder 30 is disposed so that its outer surface 30*a* is in contact with an inner wall surface 13*a* of the cylindrical space 13.

The cylinder 30 abuts, at the side of a first end opening 31, against the resin portion 22 of the igniter 20; and abuts against the circular stepped surface 45 of the projectile 40 at the side of a second end opening 32 opposite thereto.

The cylinder 30 is disposed so as to enclose the ignition portion 21 of the igniter 20 and the rod portion 41 of the projectile 40. At this point, the O-ring 44 fitted into the constricted part 43 of the projectile 40 is in contact with an inner periphery 30*b* of the cylinder 30 while an outer surface of the rod portion 41 is free from contact with the inner periphery 30*b* of the cylinder 30.

The cylinder 30 is press-fitted into the cylindrical space 13 and thereby, fixed so as not to move axially.

In this connection, the cylinder may be fixed so as not to move axially also by forming a hook portion on the outer surface 30*a* of the cylinder 30, forming a recess corresponding to the hook portion on a radially-facing inner wall surface (the inner wall surface 13*a* of the cylindrical space 13) of the housing 10, and at the time of installation, fitting the hook portion into the recess.

The conductor piece 50 is for forming part of an electric circuit when the device 1 is installed to the electric circuit.

The conductor piece 50 is a plate piece composed of a first connection section 51 and a second connection section 52 at both ends; and a cutting section 53 as an intermediate portion.

Two holes 51*a* and 52*a* of the first and second connection sections 51 and 52 are for connecting with other conductor (for example, a lead wire) in the electric circuit.

The conductor piece 50 shown in FIG. 1 is formed so that a surface of the cutting section 53 is perpendicular to surfaces of the first and second connection sections 51 and 52. However, the surface of the cutting section 53 and the surfaces of the first and second connection sections 51 and 52 may form the same surface.

Further, the conductor piece 50 may be one wherein a portion of the first connection section 51 close to the cutting section 53 and a portion of the second connection section 52 close to the cutting section 53 are deformed in their thickness directions.

The conductor piece 50 is disposed so that the surface of the cutting section 53 is perpendicular to the axial direction of the housing 10.

The surface of the cutting section 53 of the conductor piece 50 faces a tip surface 42*a* of the diameter-enlarged tip portion 42 of the projectile 40. In FIG. 1, the surface of the cutting section 53 abuts against the tip surface 42*a*, but they may face each other at an interval.

Further, when the diameter-enlarged tip portion 42 of the projectile 40 has a widthwise cross-sectional shape of a square, the length (L1) of one side and the width (W1) of the cutting section 53 of the conductor piece 50 preferably satisfy the relationship of $L1 \geq W1$, and $L1/W1$ is more preferably in the range of 1.0 to 1.2.

A box-shape stopper 60 having an opening at one side is disposed between the conductor piece 50 and the second end 12 of the housing so that its opening is present at the side of the conductor piece 50.

The box-shape stopper 60 is made of a synthetic resin, and its interior is an insulating space 61.

At the time of activation, the diameter-enlarged tip portion 42 of the projectile 40 axially moves to cut the cutting section 53 of the conductor piece 50, and then, the diameter-enlarged tip portion 42 and a cut piece of the cutting section 53 enter the insulating space 61, and thereby, cutting of the cutting section 53 achieves cut-off of the electric circuit.

Next, a method for assembling the device 1 shown in FIG. 1 will be explained by referring to FIG. 3.

The housing 10 has the cylindrical space 13, and further has an installation portion 55 for installing the conductor piece 50 as a publicly-known part and an opening 65 penetrating in the thickness direction for allowing the box-shape stopper 60 as a publicly-known part to be fitted.

The shape, structure and others of the installation portion 55 correspond to the shape or the like of the conductor piece 50, and the shape, size and others of the opening 65 correspond to the shape, size and others of the box-shape stopper 60.

First, the igniter 20 is inserted into the cylindrical space 13 from the side of the second end 12 of the housing.

Next, the cylinder 30 is inserted into the cylindrical space 13 in the same manner as the igniter 20. At this time, the cylinder 30 is inserted up to the point where its first end opening 31 side contacts the resin portion 22 of the igniter 20.

Next, the projectile 40 is inserted into the cylindrical space 13 so that the rod portion 41 enters first. At this time, the rod portion 41 enters the cylinder 30 that has been inserted earlier, and insertion is performed up to the point where the circular stepped surface 45 of the diameter-enlarged tip portion 42 abuts against the second end opening 32 of the cylinder 30.

When the rod portion 41 of the projectile 40 is inserted into the cylinder 30, the O-ring 44 is brought into contact with the inner periphery 30*b* of the cylinder 30, thereby making insertion work easy.

In this connection, it is also possible to insert, into the cylindrical space 13, the cylinder 30 and the projectile 40 which have been assembled as shown in FIG. 1.

Next, the conductor piece 50 is installed to the installation portion 55 of the housing 10.

Next, the box-shape stopper 60 is fitted into the opening 65 so that its opening side is present at the cutting section 53 side. At this time, the opening 65 is closed by side faces of the box-shape stopper 60, and an opening of the cylindrical space 13 at the second end 12 side of the housing is also closed by a bottom face of the box-shape stopper 60.

In this connection, the stopper 60 may be fixed also by forming a hook portion on a side surface of the stopper 60, forming a recess corresponding to the hook portion on the surface of the opening 65, and at the time of installation, fitting the hook portion into the recess.

In the electric circuit breaker device 1 shown in FIG. 1, the housing 10 is reinforced by disposing the cylinder 30 made of a metal inside the housing 10, and thus, the above-described first operational effect enables the housing 10 to have a smaller wall thickness, downsizing the device itself.

The electric circuit breaker device 1 shown in FIG. 1 can reduce its width-wall thickness of the housing 10 by about 30 to 80% compared to the case where the cylinder 30 is not used.

Next, operations will be explained when the electric circuit breaker device 1 shown in FIG. 1 is disposed in part of an electric circuit.

The electric circuit breaker device 1 shown in FIG. 1, in combination with a sensor and the like for detecting an abnormal current flow, can be designed to automatically start its operation when an abnormal current flows through an electric circuit, for example; and in addition, it may be designed to perform human-induced operation.

When the electric circuit breaker device 1 is disposed in an electric circuit, a lead wire forming the electric circuit is connected at the holes 51*a* and 52*a* of the first and second connection sections 51 and 52 of the conductor piece 50.

If an abnormality occurs in the electric circuit, the igniter 20 operates to generate a combustion product from the ignition portion 21.

The ignition portion 21 is enclosed at the first end opening 31 side of the cylinder 30, so the generated combustion product moves straight and collides with the rod portion 41 of the projectile 40.

In this way, the combustion product with a high temperature moves inside the cylinder 30 made of a metal and collides with the projectile 40, and the inner wall surface 13*a* of the cylindrical space 13 is not exposed directly to heat or a pressure of the combustion product. Thus, the second operational effect also allows the housing 10 to have a smaller wall thickness, downsizing the device itself.

The projectile 40 that has received a pressure from the combustion product moves axially due to the above-described third operational effect, and the diameter-enlarged tip portion 42 cuts off the cutting section 53 of the conductor piece 50.

Thereafter, the diameter-enlarged tip portion 42 and the cut piece of the cutting section 53 move inside the insulating space 61 and they are held in an electrically insulating manner.

This operation brings the first and second connection sections 51 and 52 present at both ends of the conductor piece 50 into an electrically-disconnected state, thereby breaking the electric circuit having the device 1 disposed therein.

The electric circuit breaker device of the present invention may be disposed in various electric circuits, and is especially suitable for electric circuits including automobile batteries (for example, lithium-ion batteries) and electric circuits for electric home appliances.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electric circuit breaker device comprising:

in a cylindrical space penetrating from a first end to a second end of a housing made of a synthetic resin, an igniter, a projectile made of a synthetic resin, and a conductor piece forming part of an electric circuit, which are arranged axially in this order from the first end of the housing; and having an insulating space for receiving a cut portion of the conductor piece between the second end of the housing and the conductor piece, wherein:

the conductor piece is a plate piece comprising of connection sections at both ends thereof and a cutting section as an intermediate portion, and disposed so that the cutting section has a surface perpendicular to the axial direction of the housing;

the projectile is disposed to face the surface of the cutting section of the conductor piece in the axial direction of the housing;

a cylinder made of a metal for reinforcing the housing is disposed between the projectile and an inner wall surface of the housing; and the projectile has a constricted part fitted with an O-ring, the O-ring abuts against an inner periphery of the cylinder, and the projectile has an outer surface free from contact with the inner surface of the cylinder.

2. The electric circuit breaker device according to claim 1, wherein:

the projectile has a diameter-enlarged tip portion and a rod portion with a smaller outer diameter than the diameter-enlarged tip portion, and the cylinder has a first end opening located at the side of the igniter and an opposite second end opening abutting against a stepped surface between the diameter-enlarged tip portion and the rod portion, and is disposed to enclose the rod portion.

3. The electric circuit breaker device according to claim 1, wherein:

the projectile has a diameter-enlarged tip portion and a rod portion with a smaller outer diameter than the diameter-enlarged tip portion, the igniter has a resin portion where part of a body of the igniter is enclosed with a resin, and an ignition portion is projected from the resin portion; and the cylinder has a first end opening abutting against the resin portion of the igniter and an opposite second end opening abutting against a stepped surface between the diameter-enlarged tip portion and the rod portion, and is disposed to enclose the ignition portion of the igniter and the rod portion.

4. The electric circuit breaker device according to any one of claim 1, wherein:

the projectile has a diameter-enlarged tip portion and a rod portion with a smaller outer diameter than the diameter-enlarged tip portion, the diameter-enlarged tip portion has a widthwise cross-sectional shape of a quadrangle or a circle, and the rod portion has a widthwise cross-sectional shape of a circle; and the cylinder has a widthwise cross-sectional shape of a circle.

* * * * *